United States Patent [19]

Pieperhoff et al.

[11] Patent Number: 4,886,411

[45] Date of Patent: Dec. 12, 1989

[54] PROTECTIVE MEANS FOR A LIFTING/TILTING OR TILTING DEVICE

[75] Inventors: Hans J. Pieperhoff, Zornheim; Karl-Heinz Droge, Löhne, both of Fed. Rep. of Germany

[73] Assignee: Zoller-Kipper GmbH, Mainz-Laubenheim, Fed. Rep. of Germany

[21] Appl. No.: 151,469

[22] Filed: Feb. 2, 1988

[30] Foreign Application Priority Data

Feb. 7, 1987 [DE] Fed. Rep. of Germany ..... 3703795

[51] Int. Cl.[4] ..... B60P 1/28

[52] U.S. Cl. ..... 414/408; 135/88; 135/103; 135/89; 135/108; 296/100; 296/26; 296/99.1; 414/406; 414/421; 414/409; 14/74

[58] Field of Search ..... 414/141, 406, 408, 409, 414/421; 296/99 R, 100, 101, 26; 160/202, 197, 310, 113, 118, 19; 135/88, 89, 103, 108; 52/173 DS; 14/74, 71.5

[56] References Cited

U.S. PATENT DOCUMENTS

| | | | |
|---|---|---|---|
| 3,292,971 | 12/1966 | Zucker | 296/99 |
| 3,644,952 | 2/1972 | Hatch | 135/103 X |
| 3,707,977 | 1/1973 | Grady | 135/88 |
| 4,010,973 | 3/1977 | Heinrich | 135/89 X |
| 4,032,186 | 6/1977 | Pickering et al. | 296/100 |

FOREIGN PATENT DOCUMENTS

| | | | |
|---|---|---|---|
| 3722184 | 2/1988 | Fed. Rep. of Germany | 414/408 |
| 1053230 | 2/1954 | France | 296/26 |
| 1239929 | 7/1960 | France | 296/26 |
| 1024233 | 3/1966 | United Kingdom | 135/108 |
| 2107259 | 4/1983 | United Kingdom | 135/88 |

*Primary Examiner*—Frank E. Werner

*Attorney, Agent, or Firm*—H. Gibner Lehmann; K. Gibner Lehmann

[57] ABSTRACT

The pour-in opening of the collection container of a garbage truck is provided with a shield which envelops the entire working area of the lifting/tilting or tilting device in the manner of a hood. Wall parts of the shield are movable singly or together and are moved into an operating position or a rest position by suitable power devices.

18 Claims, 3 Drawing Sheets

PROTECTIVE MEANS FOR A LIFTING/TILTING OR TILTING DEVICE

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to a protective means or structure for a lifting/tilting or tilting device intended to empty containers into the pour-in opening of a collection vehicle, in particular a garbage collection vehicle.

2. Description of the Related Art Including Information Disclosed Under 37 CFR §§1.97–1.99

Such lifting/tilting or tilting devices, generally also called pour-in or pouring devices, are used on garbage trucks in a great variety of designs in order to lift and empty them into the locally conventional garbage cans, both large and small, from their lower or street position into a raised, pour-in position, such emptying being done into the pour-in opening of a collection container on the vehicle.

As a rule, the lifting and pour-in devices have swinging arms on which the garbage cans can be hung directly, or have swinging arms which are connected via articulated guides to an additional lifting carriage. In the latter case, the garbage can is first gripped by a seat structure on the lifting carriage, then lifted and thereafter emptied into the pour-in opening of the collection container by means of a swinging motion of the swinging arms.

However, other pour-in devices are also known, which merely empty the can via a simple lifting carriage. The carriage and can are lifted vertically towards the pour-in opening of the collection container via slide or roller guides and forced by cams or articulated levers to perform a swivel motion through which the garbage cans are emptied into the pour-in opening.

These devices are generally mostly driven hydraulically, and sometimes also pneumatically. The pour-in openings of the collection containers are usually covered by dust cloths which seal the pour-in openings more or less to prevent the excessive discharge of dust caused when emptying the cans therein. Also there are in use collection containers having a housing-like pour-in opening; with this arrangement the garbage cans are first tilted against a front plate of the pour-in opening and then swung inward, together with the front plate.

All these prior pour-in devices require an operator to stand in the immediate proximity of the device or of the pour-in opening of the collection container, during the emptying operation, thus being directly exposed to the discharging dust and to the noise caused by the emptying of the cans. The disturbances resulting therefrom affect not only the operating personnel, but also the uninvolved bystanders and the environment.

SUMMARY OF THE INVENTION

It is an object of the present invention to provide in conjunction with the above-described pour-in devices, a novel and improved protective means which enhances overall the action of said pour-in devices and pour-in openings of collection containers, with respect to reducing the dust and noise disturbances thereof as well as increasing the safety to the operating personnel and to any uninvolved third parties.

According to the invention, this problem is solved in that the pour-in openings of collection containers are provided with a unique shield means which is adapted to envelop the working area surrounding the lifting/tilting or tilting device in the manner of a hood.

What the invention accomplishes is that the entire working area used by the lifting/tilting device and the attached garbage can during the required cycle of motions, is essentially completely shielded, as in a capsule. Since the shield also encloses the pour-in opening of the associated collection container it is made certain that there will be no substantial discharge of dust, and that the otherwise-occurring noise level caused by can noises, hydraulic motors and equipment motions, is lowered considerably. Also, due to shielding at the working area of the pour-in device, the risk of accidents is greatly reduced at the same time, because the arrangement is such that it is no longer possible for operating personnel to get into the working area during the pour-in operation.

In a further development of the invention, the wall parts forming the shield means are movably connected to the collection container by simple and effective guide rails.

This safety measure also has the advantage that garbage cans of various sizes can be handled and emptied by the pour-in devices. For example, a single pour-in device equipped with the protective means of the invention can empty 50 liter cans and larger sizes ranging up to 1100 liters of capacity.

Normally the size of a respective working area for a pour-in operation will vary with the size of the container to be handled. According to the present invention the shield means used for emptying either large or else small cans can be adapted to conform to the space requirement. In accomplishing this the shield means is movably connected to the collection container via guide rails to enable it to be moved into the required operating position only as far as may be required. Also, this makes it possible according to the invention, to move the shield into a completely passive position, as may be desirable for example when driving the garbage truck to the dump or between the various can-receiving stations.

In another preferred embodiment of the invention the wall parts of the shield are articulated, together and/or separately. This has the advantage that, depending on the arrangement of the shield on the collection container, one wall part can remain open to feed the cans to the pour-in opening while the other wall parts are already closed. On the one hand, this prevents uninvolved persons from accessing the working area of the equipment during the time in which the cans are being moved to the pour-in device, and on the other hand there is a saving of time since the closing of a single wall part prior to the pour-in motion involves spending considerably less time than would be required for the closing and opening motion of the entire shield.

In a further embodiment of the invention the shield means is provided with at least one electrical control circuit of the lifting/tilting or tilting device, and connected with an electric switch adapted to be coordinated with at least one of the wall elements, said switch being in the electrical control circuit and being in its "on" position only for the closed working position of the shield means.

As a consequence, the shield means acts like a safety screen whereby the pouring-in operation can be triggered only after the shield means is closed. Depending on the arrangement of the control circuit, it is also possible to initiate the pouring-in motion of the lifting/tilting or tilting device as a consequence of closing of the shield.

In an ingenious further embodiment of the invention the wall parts of the shield are constituted of elements which can be moved with relation to each other in telescopic fashion. This makes it possible to shift the shield means only the amount required to attain an operating position corresponding to a particular function of the pour-in device or function of the can size that is used, or to accommodate it in its passive position with the least space requirement on the collecting container.

In another embodiment of the invention the shield is mounted on an intermediate frame located near the pour-in opening of the collecting container. This has the advantage that the shield can be retrofitted as an accessory to already existing vehicles of collecting containers, via the intermediate frame.

Another advantage of the above embodiment is that an intermediate frame with appropriate mounting dimensions for the collecting container and the shield means can be prepared for different types of vehicles or types of collection containers, reducing any costly fitting work when assembling the shield means.

In yet another embodiment of the invention the electric or pressure medium motors are provided with rope winders, to move the shield means into its operating or its rest position. The advantage of this arrangement is that the shield means can be retracted and extended by merely pushing a button, as it were.

Other meaningful complements of the invention follow from the remaining subclaims.

BRIEF DESCRIPTION OF THE DRAWINGS

Embodiment examples of the invention are explained below in greater detail with reference to the drawing, in which.

DESCRIPTION OF THE PREFERRED EMBODIMENT

Figure 1:
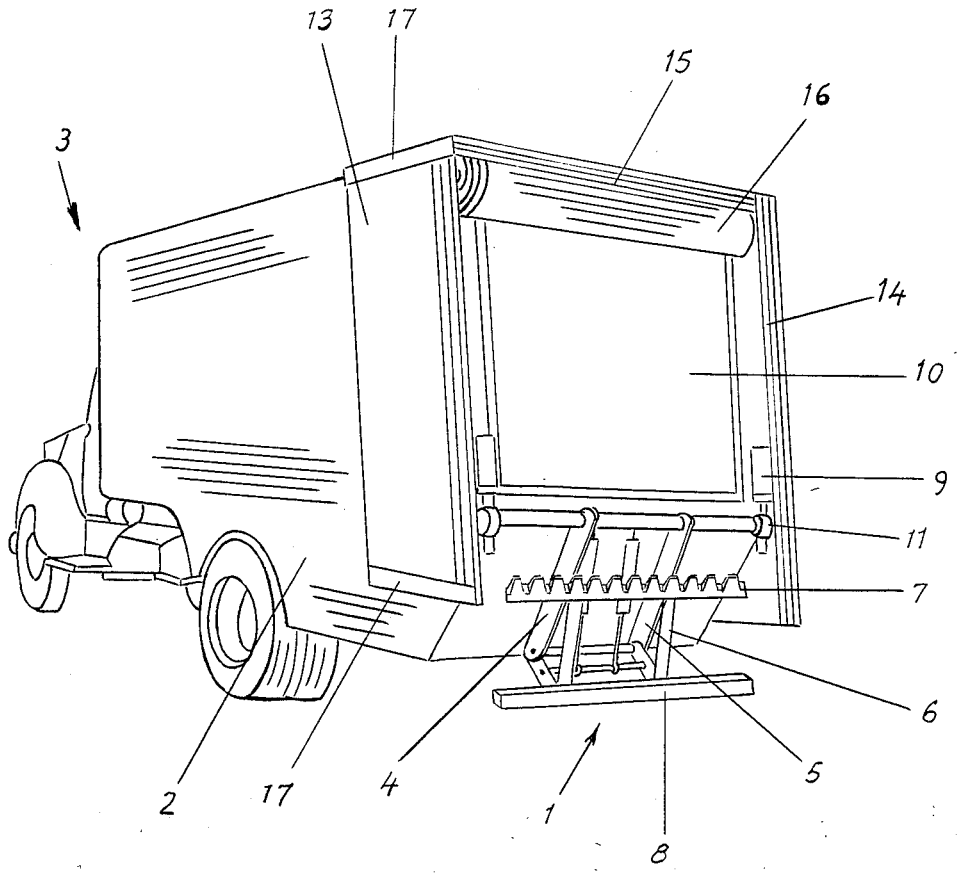
FIG. 1 is a perspective view of a protective means according to the invention, installed on a garbage collection truck and in its passive position.
Figure 2:
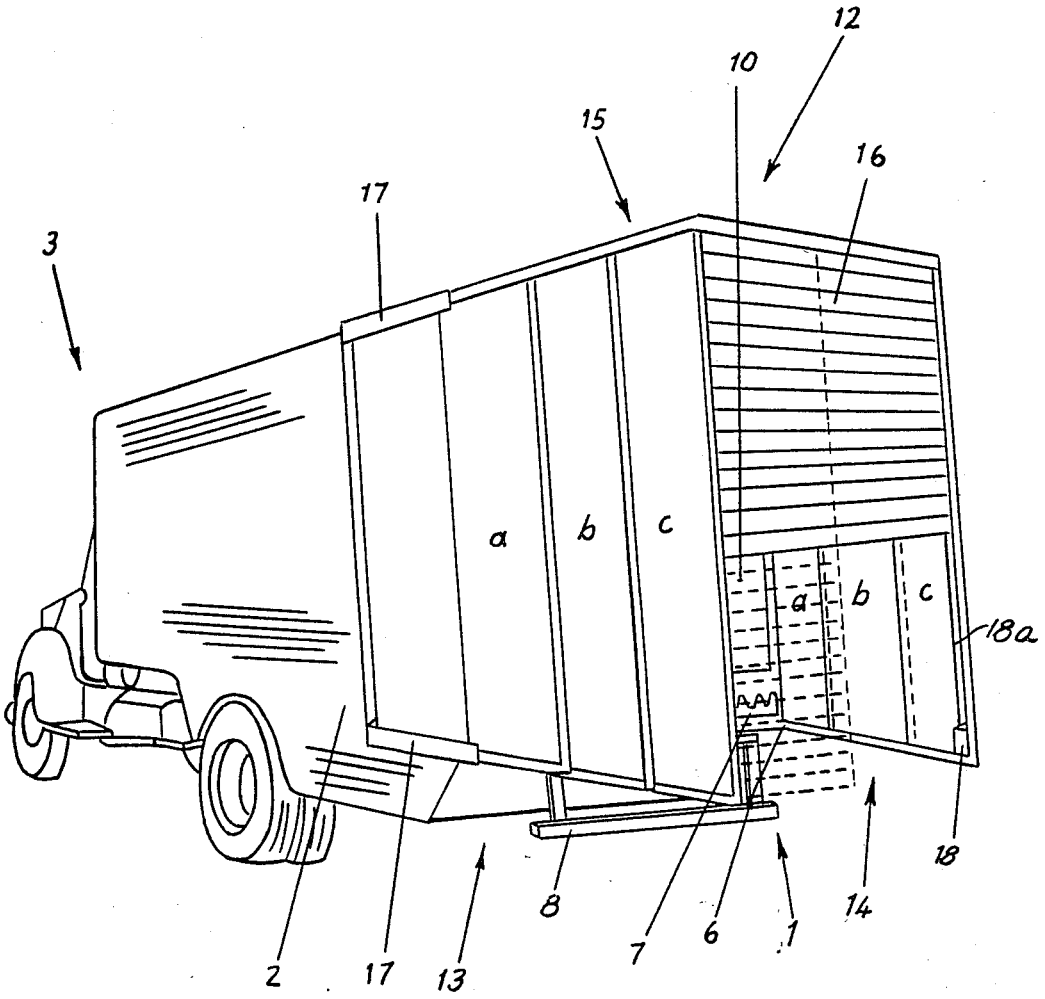
FIG. 2 is a view like that of FIG. 1, but showing the protective means in an operating position, but with an only partly closed rear wall.

Referring first to FIGS. 1 and 2 there is illustrated a protective means for the working area of a lifting/tilting device 1, said means being mounted on the rear of a truck body and collection container 2, in the example shown, the collection container 2 of a garbage truck 3. In FIG. 1 the lifting/tilting device is shown as having swinging arms 4 to which a lifting carriage 6 is mounted via an articulated guide 5. The lifting carriage 6 consists of an upper gripping rail 7 and a lower support 6, and is raised or lowered by means of actuators 9. The gripping rail 7 extends almost across the entire width of the pour-in opening 10 of the collection container 2 and is capable of accepting cans of various sizes and of tilting and emptying them into the pour-in opening 10 by means of hydraulically driven swiveling motors 11 after the lifting motion.

The use of two small lifting/tilting devices which may be actuated independently of each other, replacing the single large device 1 shown, is also common practice.

Furthermore, lifting/tilting or tilting devices may be used which have no swinging arms, but have only a lifting carriage which is guided vertically and which turns at the end of the stroke into a swivel motion via articulated or curved guides, thereby emptying the cans into the pour-in opening 10.

In fact, the particular type of lifting/tilting device employed is only of significance, in connection with the invention, inasmuch as it might essentially determine the working area that is required behind or on the side of the pour-in opening 10.

FIG. 1 further shows the protective means according to the invention in the form of a shield 12 arranged to embrace or enclose the working area of the lifting/tilting device 1. The shield 12 consists of several wall parts 13, 14, 15 and 16; it is mounted, in cantilever fashion in the passive position shown here, in cantilever guide rails 17 and an intermediate frame 19 carried by the collection container 2.

As FIG. 2 shows, the wall parts 13, 14 and 15 of the shield 12 are divided into individual elements or wall panels a, b and c, and can be moved into operating position in telescopic fashion. For this purpose, hydraulic motors with piston/cylinder units and push/pull linkages acting in scissors fashion (not shown) can be employed, or electric motors with rope winder drums (also not shown). Any other driving mode which is operative and available for the purpose, can be utilized.

An important feature of the invention is that the shield itself is mounted so as to line completely above the terrain over which the vehicle rides, as shown in FIG. 2. Also, the bottom edges of the shield walls are spaced a finite distance above this terrain whereby the shield can remain in position regardless of whether the vehicle is stationary or moving from one refuse bin location to another.

Although all the above wall parts can be mounted so as to be movable individually, it is advantageous to move the parts 13, 14 and 15 jointly into their operating or rest positions, whereas only the closing wall part 16, which is the rear wall part in the example shown, is mounted so as to be movable individually.

The closing wall part of the shield means 12 is understood to be the wall part which is being kept open for the operating personnel to enable them to bring the garbage cans to the lifting/tilting device. While this is usually the rear wall part, the deciding factor here is exclusively the operating mode of the operating personnel or of the lifting/tilting device.

This makes it a matter of course that, in lifting/tilting devices which automatically pick up the cans laterally, e.g. from the curb, or in lifting/tilting devices where the operating personnel bring the cans to a device which does not tilt in the predominantly usual direction, the wall part best suited when taking all external influences into account is provided as the closing wall part.

In the example shown in FIG. 2 the rear wall part 16 is partially opened so that the operating personnel can bring the garbage cans to the lifting/tilting device 1 unhindered. The opening width is controlled by sensors and light barriers not shown here, or else by manual prior adjustment. This also applies to the closing wall part 16.

During its closing motion, the rear wall part 16 traverses a switch 18 which closes a control circuit (not shown). The lifting/tilting device can only be operated after this control circuit has been closed.

However, this control circuit can also be designed so that, by actuating the switch 18 the lifting/tilting device 1 will perform its operating motion automatically with a certain time delay.

Figure 3:
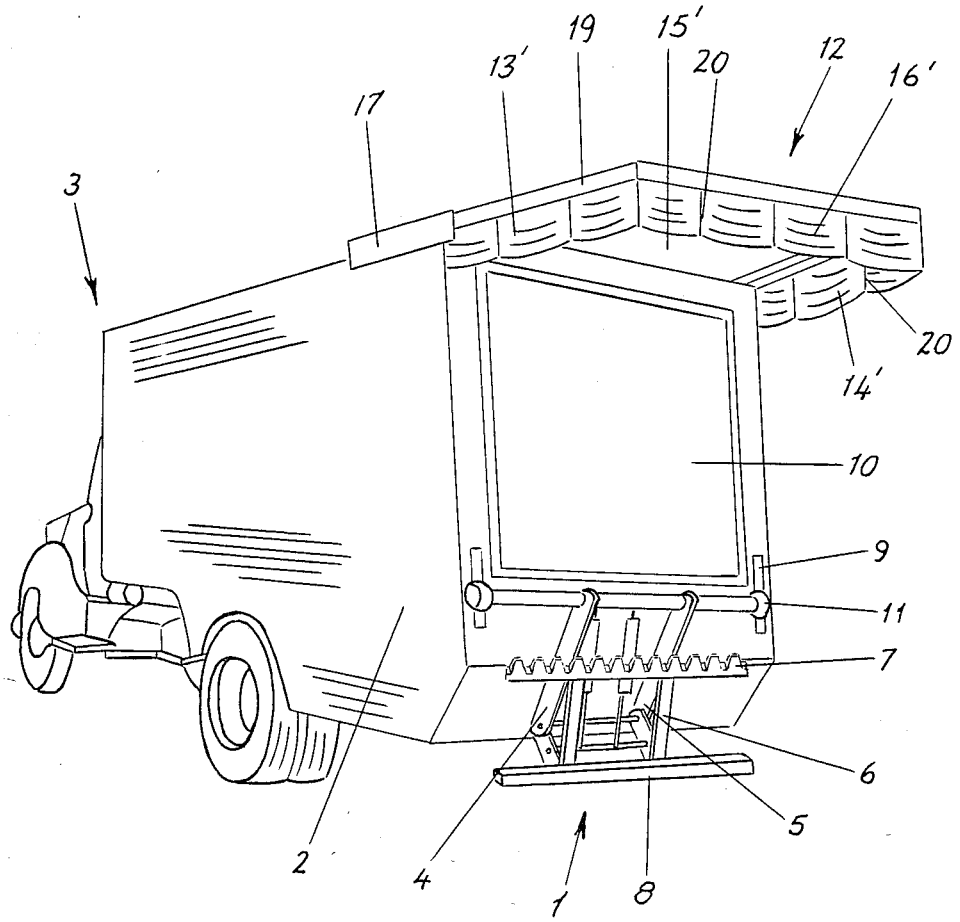
FIG. 3, is a perspective view of an installed protective means according to the invention, constituting a modified construction.

In the example shown in FIG. 3 the shield 12' is mounted on an intermediate frame 19 that is provided above the pour-in opening 10 of the collection container 2. The intermediate frame 19 is movably mounted in the guide rails 17' so that it can be brought into either an operating position or else a rest position. The wall parts 13', 14' and 16' consist in this example of a foldable sheet material folded in laminar fashion and capable of being lowered from the top by ropes 20. But other wall parts which can be telescoped or else moved like blinds can be provided also. The wall part 15' can consist of a stretch cloth (not shown) which can be extended and retracted with the intermediate frame 19 by means of spring winders (not shown), if the shield 12' is operated manually. However, the intermediate frame 19 of the shield 12' can also be moved automatically into the operating and rest positions by suitable power means (not shown), as in the examples of FIGS. 1 and 2 described above.

The intermediate frame 19 can also be used for the shield means shown in FIGS. 1 and 2, in which case the guide rails 17 are preferably mounted in connection with the intermediate frame.

The wall parts 13, 14, 15 and 16 of the shield 12 are preferably made of a sound-damping material dyed in a safety/warning color. On the one hand, this reduces the noise of the lifting/tilting or tilting device 1 or the emptying noises to a minimum and on the other hand the warning color constitutes a safety factor for uninvolved third parties.

The invention is not restricted to the example shown; it can also be applied to other collection containers or pour-in devices not described here, for instance to so-called front loading systems where the garbage cans are emptied into a garbage truck from the front. Then one only has to see to it that the shield 12 is mounted without the upper wall part 15, if the garbage can is emptied into a pour-in opening disposed above and behind the cab of the garbage truck.

Or, if two individual pour-in openings are provided and operate independently and next to each other, the closing wall part 16 can be made of sections which close the working area of the respective individual openings separately, such as indicated in FIG. 2 in broken lines.

In summary it will now be seen that we have provided a novel and improved shield or protective means adaptable for application to garbage and refuse collection vehicles, said means constituting a new combination with a truck body of the type having a collection container that presents a pour-in opening. Such new combination includes a mounting means that is connected with said collection container, a hood supported by the mounting means, the hood having a top section which overlies the loading area that fronts on the pour-in opening, including extensible and retractable side wall means supported by said mounting means, said side wall means being adapted to extend downwardly from the top section of the hood to enclose opposite sides of the loading area, and being retractable to provide side access to the loading area, and further including extendable and retractable rear wall means which are operable independently of the side wall means and which are adapted to extend downwardly from the top section of the hood, or else retract upwardly to provide access to said loading area.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

LIST OF REFERENCE SYMBOLS

1 Lifting/tilting device
2 Truck body and collection container
3 Garbage truck
4 Swinging arm
5 Articulated guide
6 Lifting carriage
7 Gripping rail
8 Lower support
9 Pressure medium cylinder
10 Pour-in opening
11 Pivoting motor
12 Hood or shield
13, 14, 15, 16 Wall parts
17 Shield mounting means or guide rails
18 Switch
19 Intermediate frame
20 Ropes
a, b, c Wall panels

What is claimed is:

1. A protective means for lifting/tilting or tilting device of the type adapted to empty containers into a pour-in opening of a collection container, in particular of a garbage collection vehicle, characterized in that the pour-in opening (10) of the collection container (2) is equipped with a shield (12) which envelops the working area of the lifting/tilting or tilting device (1) in the manner of a hood, in that the collection container (2) has guide rails (17) and said shield (12) has wall parts (13, 14, 15, 16) which are movably connected to the collection container (2) by said guide rails (17), in that the shield (12) contains at least one electrical control circuit for the lifting/tilting or tilting device, and in that an electric switch (18) is provided, disposed in said electrical control circuit having its "on" position corresponding only to the closed operating position of the shield (12), said switch being mounted on and responsive to the movement of at least one of the wall parts (13, 14, 15, 16).

2. A protective means for a lifting/tilting device of the type adapted to empty containers into a pour-in opening of a collection container of a garbage collection vehicle, characterized in that the pour-in opening (10) of the collection container (20) is equipped with a shield (12) which envelops the working area of the lifting/tilting device (1) in the mannner of a hood, and further characterized by cantilever mounting means on the collection vehicle, said mounting means having overhanging portions free of support by the underlying terrain, for operatively supporting the said shield (12) a finite distance above said terrain during stand-still of the collection vehicle and also during travelling movements thereof, said shield (12) having, when it is operative position, wall parts which are disposed at a distance from said lifting/tilting device so as to form a closable working room in which the container to be emptied can be connected with the said lifting/tilting device for effecting limiting and tilting of both the container and the said lifting/tilting device and also for effecting a take-off of the emptied container from said lifting/tilting device all within the said closed working room, said shield having at least one closing wall part which is movable between (a) a raised open position to provide access for bringing a container to be emptied into said working room and for removing the container when emptied from said working room and (b) a lowered closed position to close said working room during the lifting and tilting of the container to be emptied, and during emptying of the container and tilting back and lowering of said container when emptied.

3. Protective means according to claim 2, characterized in that the collection container (2) has guide rails (17), and said shield (12) wall parts (13, 14, 15, 16) are movably connected to the collection container (2) by said guide rails (17).

4. Protective means according to claim 3, characterized in that the wall parts (13, 14, 15, 16) of the shield (12) are mounted by said guide rails (17) so as to be individually movable thereon.

5. Protective means according to claim 3, characterized in that the wall parts (13, 14, 15, 16) of the shield (12) are mounted by said guide rails (17) so as to be simultaneously movable thereon.

6. Protective means according to claim 3, characterized in that the wall parts (13, 14, 15, 16) of the shield (12) consist of elements (A, B, C,) movable in telescopic fashion.

7. Protective means according to claim 3, characterized in that the wall parts (13, 14, 15, 16) of the shield (12) comprise sound-dampened material.

8. Protective means according to claim 3, characterized in that the wall parts (13, 14, 15, 16) of the shield (12) have a safety-warning color.

9. Protective means according to claim 2, characterized in that there is an immediate frame (19) around the pour-in opening (10) of the collection container (2), said shield (12) being mounted on said frame.

10. Protective means according to claim 2, characterized in that rope lifters (20) are provided to move the shield (12) into its operating and rest positions.

11. A refuse-collection vehicle comprising, in combination:

(a) a truck body having a collection container (2) presenting a pour-in opening (10) and having a lifting/tilting device located below said pour-in opening, (b) cantilever mounting means (17) connected with said collection container, said cantilever mounting means having overhanging portions free of support by the underlying terrain, (c) a hood (12) supported by said cantilever mounting means, the bottom of said hood being supported at a finite distance above said terrain, said cantilever mounting means operatively supporting the said hood (12) during standstill of the collection vehicle and also during travelling movements thereof, (d) said hood having a top section (15) overlying the loading area which fronts on said pour-in opening (10), (e) extensible and retractable side wall means (13, 14, a, b, c, 13′ 14′) wholly supported by said cantilever mounting means, said side wall means being adapted to extend downwardly from the top section of said hood to enclose opposite sides of said loading area and to form a closable working room enclosing said loading area and being retractable to provide side access to said loading area, and (f) extendable and retratable rear wall means (16, 16′) disposed opposite said pour-in opening (10) and operable independently of said side wall means, said rear wall means being extendable downwardly from the top section of said hood and retractable upwardly towards said top section to provide access to said loading area for the purpose of bringing a container to be emptied into said working room and removing the container when emptied from said working room.

12. The combination of claim 11, and further including:

(a) power actuated means (20) for operating said side wall and rear wall means.

13. The combination of claim 12, wherein:

(a) the side wall means (13′, 14′, and rear wall means (16′) comprise foldable sheet material.

14. The combination of claim 11, wherein:

(a) said side wall means (13, 14) includes telescoping panels (a, b, c).

15. The combination of claim 11, and further including:

(a) an intermediate frame structure (19) supported by said mouting means (17) and engaged by said hood (12).

16. The combination of claim 15, wherein:

(a) the intermediate frame structure (19) is movably carried by the mounting means (17) and is movable under power between extended and retracted positions.

17. A refuse-collection vehicle comprising, in combination:

(a) a truck body having a collection container (2) presenting a pour-in opening (10), (b) mounting means (17) connected with said collection container, (c) a hood (12) supported by said mounting means, (d) said hood having a top section (15) overlying the loading area fronting on said pour-in opening (10), (e) extensible and retractable side wall means (13, 14, a, b, c, 13′, 14′) supported by said mounting means, said side wall means being adapted to extend downwardly from the top section of said hood to enclose opposite sides of said loading area, and being retractable to provide side access to said loading area, and (f) extendable and retractable rear wall means (16, 16′) operable independently of said side wall means, and extendable downwardly from the top section of said hood, said rear wall means being retractable upwardly to provide access to said loading area, (g) an electric switch (18) actuated by one of said wall means to prevent dumping unless the one wall means is substantially fully extended downward from the top section of the hood.

18. A protective means for a lifting/tilting or tilting device of the type adapted to empty containers into a pour-in opening of a collection container, in particular of a garbage collection vehicle, characterized in that the pour-in opening (10) of the collection container (2) is equipped with a shield (12) which envelops the working area of the lifting/tilting or tilting device (1) in the manner of a hood, in that said shield (12) has wall parts (13, 14, 15, 16) which are movably connected to the collection container (2), and the shield (12) contains at least one electrical control circuit for the lifting/tilting or tilting device, and in that an electric switch (18) is provided, disposed in said electrical control circuit and having its "on" position corresponding only to the closed operating position of the shield (12), said switch being mounted on and responsive to the movement of at least one of the wall parts (13, 14, 15, 16).

* * * * *